United States Patent [19]

Keaton

[11] Patent Number: 4,544,202

[45] Date of Patent: Oct. 1, 1985

[54] SEMIAUTOMATICALLY ACTUATED ROTABLE LOUNGE CHAIR

[76] Inventor: Tanya L. Keaton, 29168 Kearsley, Millbury, Ohio 43447

[21] Appl. No.: 344,022

[22] Filed: Jan. 29, 1982

[51] Int. Cl.[4] ..... A47C 1/02

[52] U.S. Cl. ..... 297/349; 248/425

[58] Field of Search ..... 297/349; 248/425

[56] References Cited

U.S. PATENT DOCUMENTS

| | | | |
|---|---|---|---|
| 2,876,051 | 5/1959 | Fox | 248/425 X |
| 2,916,084 | 12/1959 | Bottemiller | 297/349 X |
| 3,053,568 | 9/1962 | Miller | 297/349 X |

FOREIGN PATENT DOCUMENTS

| | | | |
|---|---|---|---|
| 207015 | 2/1909 | Fed. Rep. of Germany | 297/349 |
| 378825 | 9/1923 | Fed. Rep. of Germany | 248/425 |

*Primary Examiner*—Francis K. Zugel

*Attorney, Agent, or Firm*—George R. Royer

[57] ABSTRACT

A semiautomatically actuated rotatable chair which can be rotated by the chair user from a sitting position in such chair. Such chair is comprised of a base member having integrally and fixed disposed horizontally on its upper surface a ring gear member. Moreover, said chair comprises a rotatable member with a seat on its upper portion, which rotatable member is disposed above the base member for rotation about the base member through a follower gear integrally affixed on the lower surface of the upper member.

1 Claim, 5 Drawing Figures

SEMIAUTOMATICALLY ACTUATED ROTABLE LOUNGE CHAIR

BACKGROUND OF INVENTION

The subject invention relates to the furniture art and specifically pertains to a chair which can be rotated in a circular movement from a fixed position while the person is seated in the chair. More particularly, as discussed hereinbelow, the subject invention is particularly applicable to the lounge chair art and is directed to those types of chairs, of the indoor or outdoor variety, which can be rotated by the person seated in the chair while seated therein.

Rotatable chairs are not new in the art and most persons are familiar with chairs which can be rotated manually by foot or other movements. Additionally, some chairs such as barber chairs can be rotated by the action of a pneumatically operated system. Other such variations exist in the pertinent furniture art.

However, no inventions exist in the present state of the art which possess the feature which allows the person seated or reclined in the chair to move the chair in a circular direction by semiautomatic means by his own manual manipulations on integrally affixed members. Such a development in the outdoor furniture art will yield unique utility features of significant benefit. For instance, in the use of outdoor lounge chairs for sunbathing, as the earth rotates, it causes a relative change of the sun's position; and thus it becomes desirable in such event, for the chair user to get up and move the chair in a radial direction to optimally align the chair directly into the sun for maximum sunbathing benefits. This latter act requires the person to stand up and rotate the chair, by manual movement, and then to set it down again before reclining on the chair. In this latter regard, no known invention encompasses features necessary to semiautomatically rotate a lounge chair into the desired positions without requiring the user to stand up and move the chair. The subject invention herein is directed to the end of providing such a semiautomatically movable lounge chair; and the following objects of the subject invention are directed accordingly.

OBJECTS

It is an object of the subject invention to provide an improved chair;

It is also an object of the subject invention to provide an improved rotatable chair;

Yet another object of the subject invention is to provide an improved semiautomatically movable chair;

Still another object of the subject invention is to provide an improved mechanism for semi-automatically rotating a chair;

It is still another object of the subject invention to provide an improved semiautomatically movable lounge chair;

A further object of the subject invention is to provide an automatically movable lounge chair;

Still another object is to provide an improved lounge chair;

A further object of the subject invention is to provide a rotatable chair which can be moved by the user without requiring such user to move out of the chair's seated position for effecting such movement.

Other and further objects of the subject invention will become apparent from a reading of the following description taken in conjunction with the drawings.

DRAWINGS

In the drawings.

DESCRIPTION OF GENERAL EMBODIMENT

The subject invention is a semiautomatically movable loung chair which can be rotated by the user while in a seated position, said device comprising an upper seat position and a lower base position. The lower base protion is adapted to set rigidly in the ground. The upper surface of the base member has a horizontally disposed ring gear arrangement, while the lower portion of the upper member has an integrally disposed follower gear which is adapted to ride eccentrically around the ring gear. The follower gear is affixed intermediately to a ratchet or other appropriate lever mechanism to move the follower gear around the ring gear, thereby moving the upper member around the base or lower member.

DESCRIPTION OF PREFERRED EMBODIMENT

The preferred embodiment of the subject invention is described hereinbelow and while a preferred embodiment is being described such description shall not be considered as limting the scope of the subject invention.

In describing the preferred embodiment the following reference nomenclature will be used:

(a) The word "upper" will be used in reference to the portions of the device incorporating the subject invention located above the ground, (b) The word "lower" will be used in reference to those portions of the subject device located below the ground.

Figure 1:
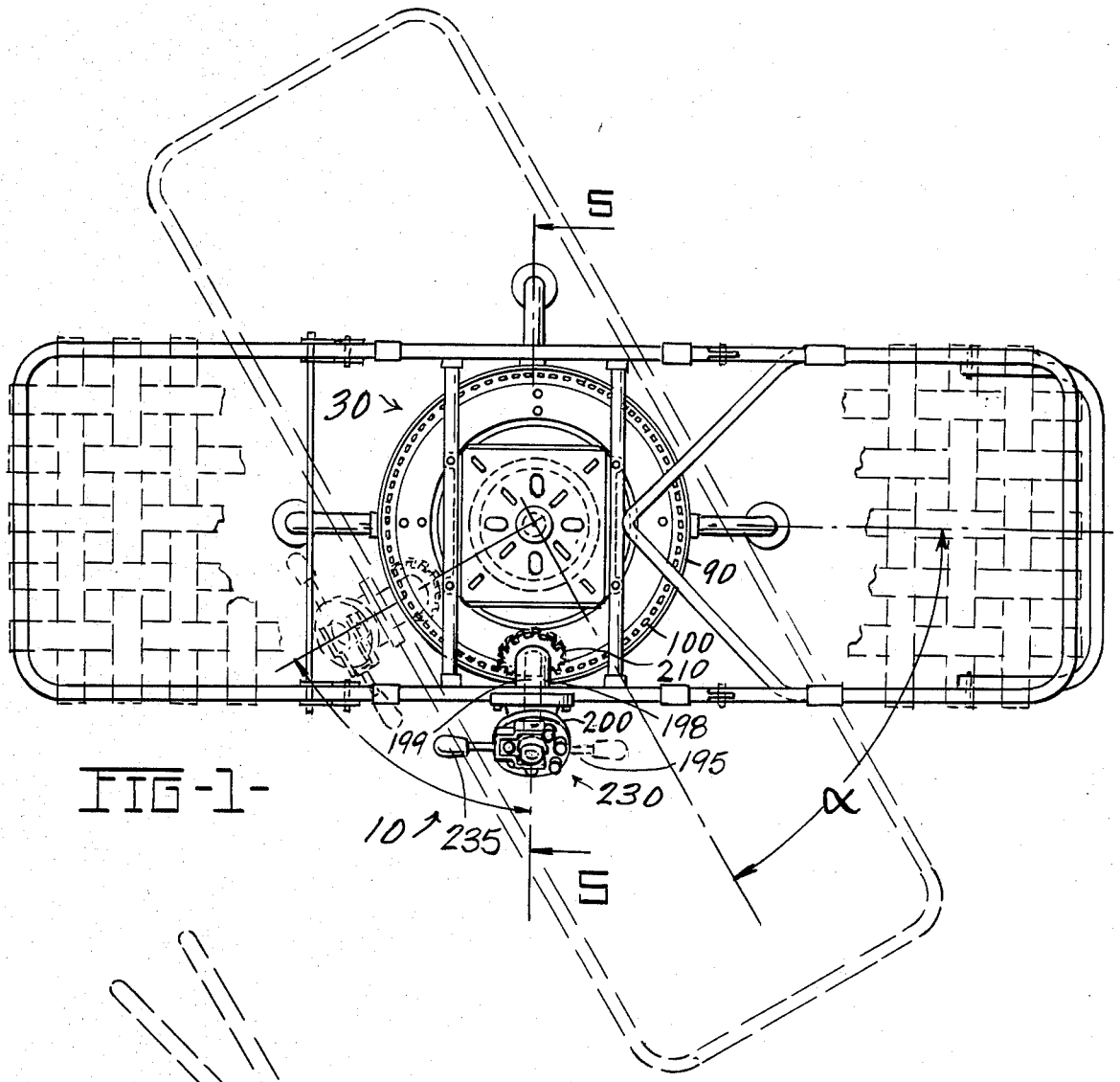
FIG. 1 is a top elevational view of the subject invention.
Figure 2:
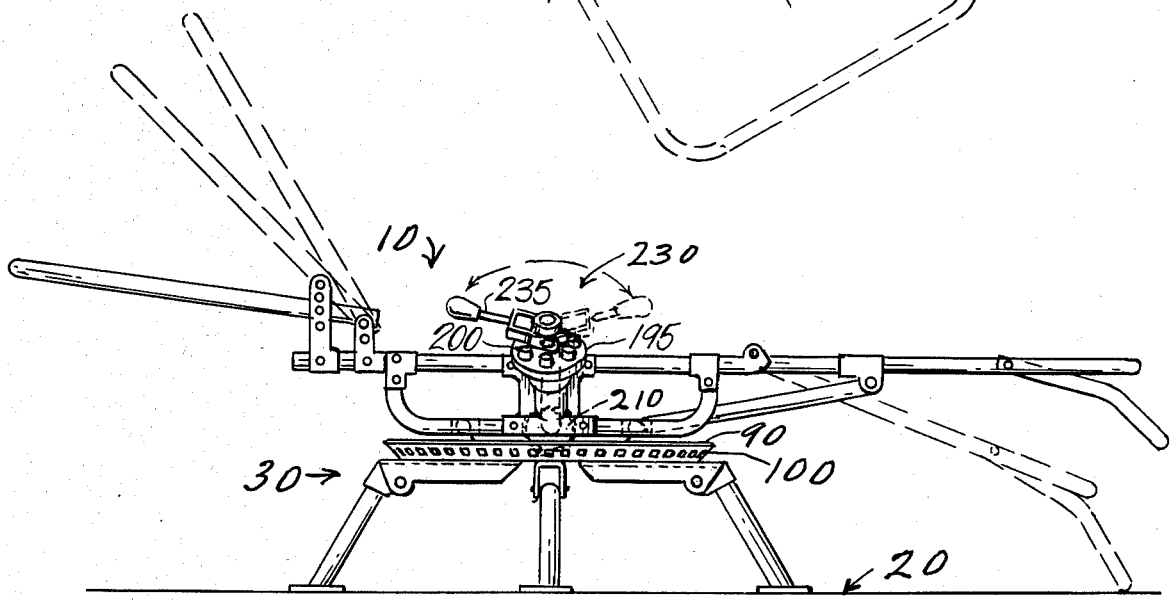
FIG. 2 is a side elevational view of the subject invention.

Referring now in particular to FIGS. 1 and 2 in which the preferred embodiment of the subject invention is shown, a rotatable lounge chair 10 incorporating the features of the subject invention is shown. Such lounge chair 10 is adapted to rest in a conventional position on the ground 20 as shown. More particularly, chair 10 is comprised of an upper portion 45 and a lower base member 30 with four vertically disposed supportive legs 40A, 40B, 40C and 40D adapted to rest on the ground in the dispostion generally shown in FIGS. 1 and 5. As seen particularly in FIGS. 2 and 5, the legs 40A, 40B, 40C and 40D are retractible as an optional feature.

The upper portion 45 of the lounge chair 10 is comprised of a rotatally mounted seating platform 50, which seating platform is adapted to hold a conventional lounge seat 60 on its upper surface, as shown in the drawings. The lounge seat 60 is exposed on its upper surface so that the user can rest on top thereof, either in a seated or reclined position, as desired.

Figure 4:
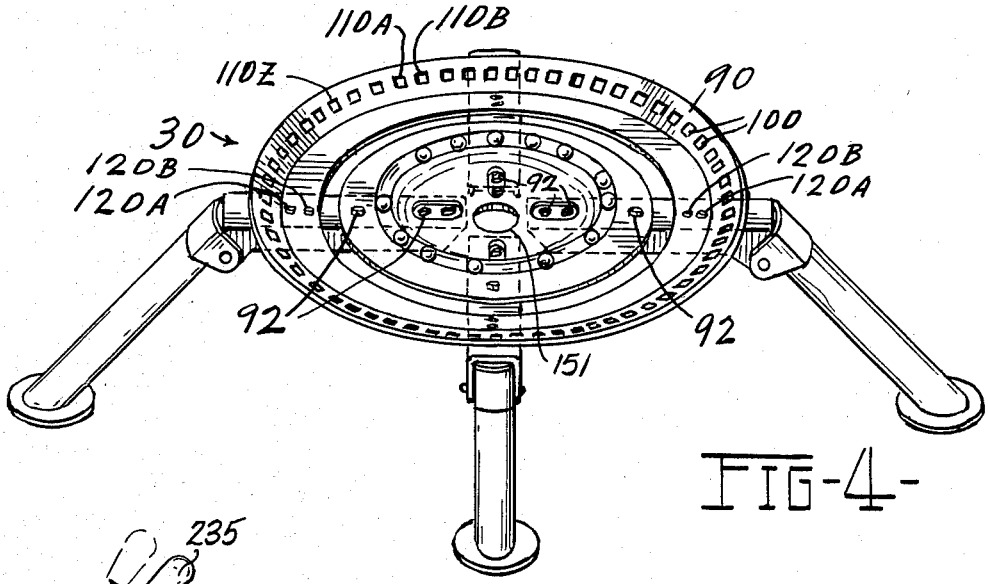
FIG. 4 is a perspective view of the lower base portion of the chair incorporating the subject invention, as viewed from above.

Referring now in particular to FIG. 2, the lower base member 30 is shown as having an upper surface 90 and a lower surface 92. The vertically depending support legs 40A, 40B, 40C and 40D, as shown, depend vertically downwardly from such lower surface 92 of such base member and the lower protions of such legs rest firmly on the ground as shown. As shown, integrally and rigidly disposed in a horizontal position and on the upper surface 90 of the base member 30 is ring gear member 100, the center of which is preferably positioned in the middle of the base member, as represented in FIG. 4. By such latter positonal relationship, the ring gear is generally in a symmetrical position on the upper surface 90 of the base member 30, as viewed from an end elevational view of FIG. 2.

In the embodiment shown in the drawings the ring gear 100 does not comprise male protruding teeth, but instead is comprised of a series of evenly spaced indented members 110A, 110B, 110C . . . 110Z, which indented members are disposed in such series fashion around the inner circumferential surface of the upper circular portion 90 of the lower base member 30. A ring gear with positive male teeth, or any other suitable gearing arrangment, can be used as an alternative to ring gear 100, so long as the appropriate mating relationship is effected with follower gear 210 on the upper member 45, as more particularly described hereinbelow.

In the embodiment shown, the lower surface of the ring gear 100 can be secured to the upper surface 90 of the lower base member 30 by a plurality of vertically disposed bolt members 120A, 120B . . . 120Z, as indicated.

Figure 3:
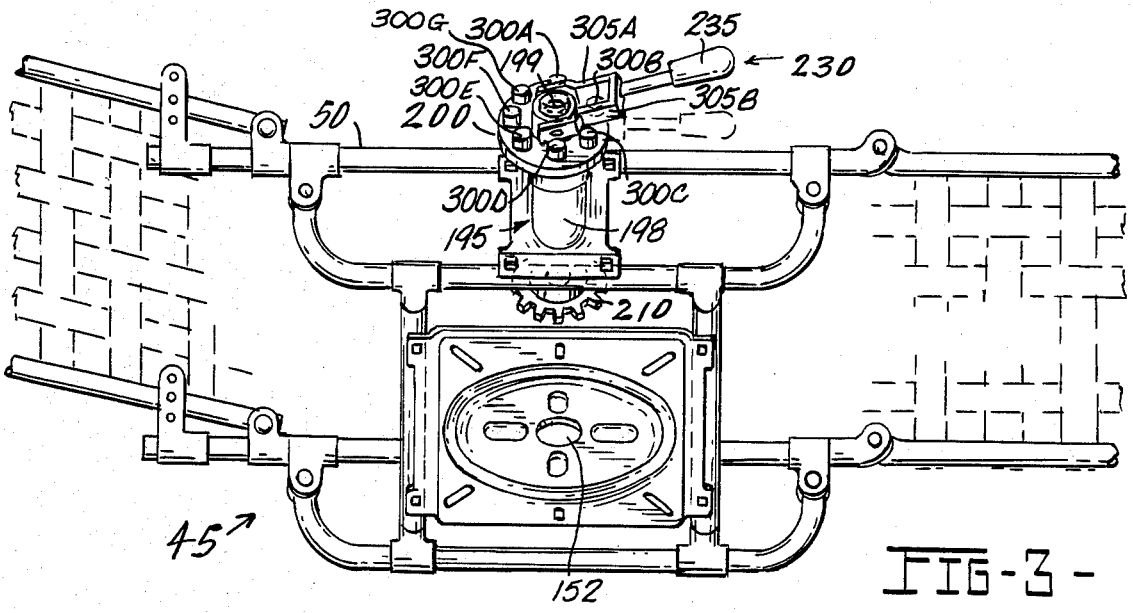
FIG. 3 is a perspective view of the upper part of said chair looking at said upper part from the bottom.
Figure 5:
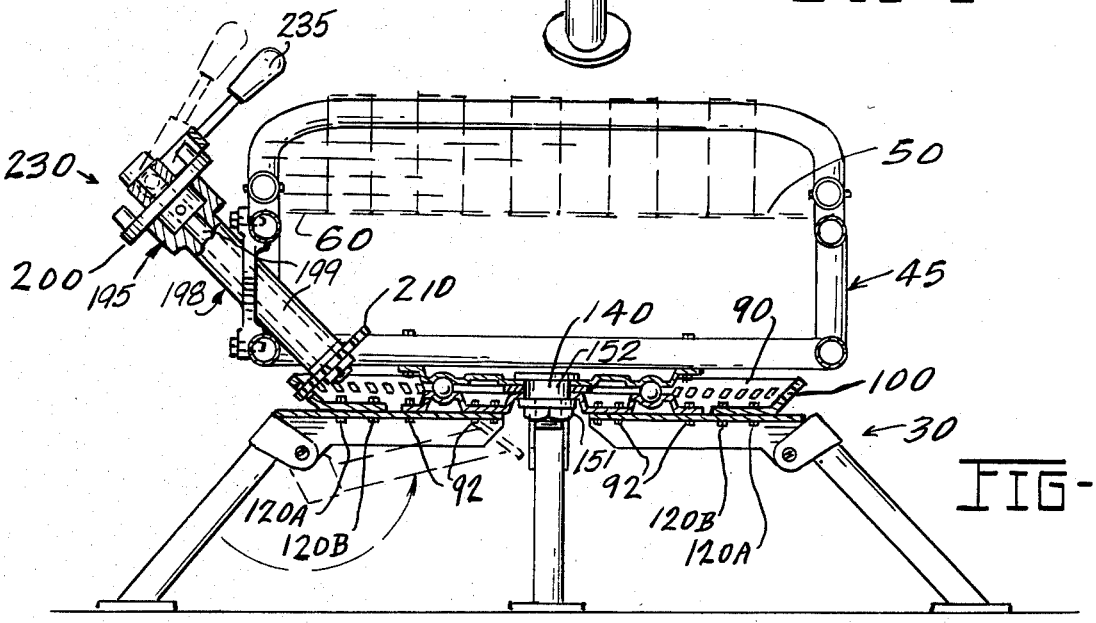
FIG. 5 is an end elevational view of the subject invention.

As seen in FIG. 3, the upper surface 90 of lower base member 30 has a circular opening 151 therein to receive a vertical cylindrical shank 140 therethrough. In similar fashion, the lower surface of upper member 45 has a mating circular opening 152 disposed therein as shown in FIG. 3. Vertical shank 140 is fitted conformingly through openings 151 and 152 as shown in FIG. 5. Once so placed, the upper member 45 revolves about lower member 30 on the cylindrical shank 140, as a pivot point. This shank 140 thus serves to support, in a centrally located position, the upper member 45 onto the lower member 30.

Integrally mounted on the upper member 45 is a hand operated actuator 195 structured to enable the user to rotate the upper member 45 about the lower member 30. As shown in FIGS. 1, 2, 3 and 5, in particular, the actuator 195 is comprised of a base cylindrical member 198 which houses a longitudinal shaft 199. More specifically, the base cylindrical member 198 is adapted to house shaft 199 so that shaft 199 can rotate concentrically within the base cylindrically member 198. The lower end of shaft 199 has a follower gear 210 which is concentrically mounted to the lower end of shaft 199 and is adapted to ride circumferentially about inner circumference of the ring gear 100, with the follower gear circumference engaging the female openings 110A . . . 110Z. The upper portion of cylindrical member 198 is equipped with a ratchet mechanism 230 disposed on a head 200 on cylinder 198, as shown. This ratchet mechanism comprises the circular head 200 mounted concentrically and integrally on the upper end of shaft 199. Integrally disposed on the upper surface of said circular head are a plurality of upwardly protruding bosses 300A . . . 300G. Bosses 300A . . . 300G are engageable by the inner parallel ends 305A and 305B of a handle member 235. Handle member 235 is pivotable about its inner end, thus when the handle 235 is pivoted down its inner ends 305A and 305B will engage one of the bosses 300A . . . 300G, and the handle 235 when moved will cause shaft 199 to move correspondingly. The ratchet in turn is connected to the upper part of shaft 199, and reciprocating movement of the handle 235 causes shaft 199 to rotate and move the gear 210 to ride about the ring gear 100. This causes the upper member 45 to be rotated about the lower member 30 in proportion to the degree of movement of the follower gear 210 about ring gear 100.

While a preferred embodiment of the subject invention has been described, such limited description shall not be construed to limit the scope of the subject invention.

I claim:

1. A portable outdoor chair, having a seat portion, which seat portion is capable of being semi-automatically rotated in a horizontal plane about a base member, said device comprising:

(a) a base member with vertically depending legs for fixedly positioning said base member on the ground, said base member having a horizontally disposed plate member disposed on the upper surface of said base member, said plate member comprising on its peripheral surface a ring gear member with female openings on the circumference thereof to receive male gear teeth;

(b) an upper pivotable member pivotally mounted to the lower base member, said upper pivotable member having seat means integrally affixed to the upper portion of said upper pivotable member;

(c) combined ratchet and movement means integrally disposed on said upper pivotable member about said base member in a pivotable manner, said combined movement and ratchet means comprising a longitudinal shaft member, said shaft member being housed in a cylindrical housing and wherein said shaft has an upper end and a lower end, wherein said upper end has a circular head concentrically mounted on said end, and on the upper surface of said circular head is mounted a plurality of bosses and a pivotable handle, one end of which is engageable with one or more such bosses when said handle is pivoted downwardly, whereas said handle when engaged against one or more such bosses will cause said shaft to rotate, and wherein mounted concentrically on the lower end of said shaft is a circular follower gear adapted to movingly engage the ring gear on said base member such that rotation of the shaft by said handle will cause said shaft to rotate said follower gear about said ring gear causing the upper pivotable member to pivot about said base member.

* * * * *